United States Patent [19]

Waeldner et al.

[11] 3,937,398

[45] Feb. 10, 1976

[54] CONDITIONED AIR DISTRIBUTION SYSTEM

[75] Inventors: William J. Waeldner, Waverly; William J. Harris, Tunkhannock, both of Pa.

[73] Assignee: Dynamics Corporation of America, New York City, N.Y.

[22] Filed: Sept. 6, 1974

[21] Appl. No.: 503,784

[52] U.S. Cl. ..... 236/38; 137/805; 236/49; 236/80 D

[51] Int. Cl.[2] ..... F24F 11/00; F15C 4/00

[58] Field of Search ..... 236/49, 80, 680, 79, 38; 165/30, 31; 137/805

[56] References Cited

UNITED STATES PATENTS

| | | | |
|---|---|---|---|
| 3,482,623 | 12/1969 | Betz | 165/30 X |
| 3,840,177 | 10/1974 | Osheroff | 236/49 |

*Primary Examiner*—William E. Wayner
*Attorney, Agent, or Firm*—McCormick, Paulding & Huber

[57] ABSTRACT

An air distribution system supplies conditioned air to at least one zone to be conditioned and comprises a supply duct connected with a diffuser discharging into the conditioned zone. A modulating valve in the supply duct is provided with a bellows actuator for regulating the flow of air into the zone and a secondary conditioning apparatus such as a heater is provided in the supply duct for warming the air before introduction into the zone. The control system for the bellows actuator and for the secondary conditioning apparatus is of the fluidic type with power for the actuator and control system supplied from a total pressure pick-up in the duct. A thermostat for supplying temperature responsive fluidic signals to the bellows and control system is provided with manual adjustments for setting the minimum and maximum flow rates of conditioned air into the zone.

15 Claims, 8 Drawing Figures

CONDITIONED AIR DISTRIBUTION SYSTEM

BACKGROUND OF THE INVENTION

This invention relates to air distribution systems and deals more particularly with air conditioning distribution systems having self-powered controls.

In our co-pending U.S. Pat. application Ser. No. 306,559, filed Nov. 15, 1972, now U.S. Pat. No. 3,837,571 entitled "Self-Controlled Air Distribution System", there is disclosed an air distribution system having a fluidic control system powered by duct air pressure. The air distribution system disclosed therein utilizes a variable restrictor, associated with the thermostat, for establishing a pressure reference signal for comparison with actual duct pressure. As a result, the temperature sensitivity of the thermostat is a function of the maximum pressure setting.

It is desirable to have a distribution system in which the temperature sensitivity is not affected by variations in the maximum pressure setting and, correspondingly, the maximum output of the system. This goal cannot be achieved in the system disclosed in the referenced U.S. patent application because of the variable restrictor which inhibits air delivery throughout the entire temperature control range.

It is also known to utilize a secondary conditioning apparatus in an air distribution system to locally heat or cool the conditioned air from a remote source such as a central air conditioner. In the conditioning system having a fluidic control system regulating the discharged air, it is desirable that the secondary conditioning system also be fluidically controlled. It has been found that fluidic controls for a secondary system can be advantageously integrated with discharge controls and the two controls may share common sensors.

It is, accordingly, a general object of the present invention to disclose an air distribution system having a temperature sensitivity which remains uniform in spite of variations in the desired maximum output and which distribution system employs fluidic controls for regulating the discharge and secondary conditioning systems.

SUMMARY OF THE INVENTION

In accordance with a preferred embodiment of this invention, an improved fluidic thermostat is provided in a fluid distribution system with a manually adjustable limiting means for setting the maximum output or discharge pressure and thereby eliminating the need for a variable restrictor. The resulting thermostat has a constant temperature sensitivity regardless of the maximum output setting.

Another limiting means may also be provided in the thermostat for setting the minimum temperature signal. This limiting means serves to insure at least a minimum flow of conditioned fluid, usually cooled or heated air, into the zone to be conditioned. In addition, means for sensing when the thermostat is operating in proximity to one of its limits and providing an appropriate control signal may be included in said thermostat.

The air conditioning system may include a secondary conditioning apparatus for further conditioning the air before it is introduced into the zone. The secondary conditioning may be in the nature of warming, cooling, or the like. A fluidpowered control system for operating the secondary conditioning apparatus is provided and may be controlled by the limit sensor signal from the thermostat or any other appropriate source.

DESCRIPTION OF THE PREFERRED EMBODIMENT

Figure 1:
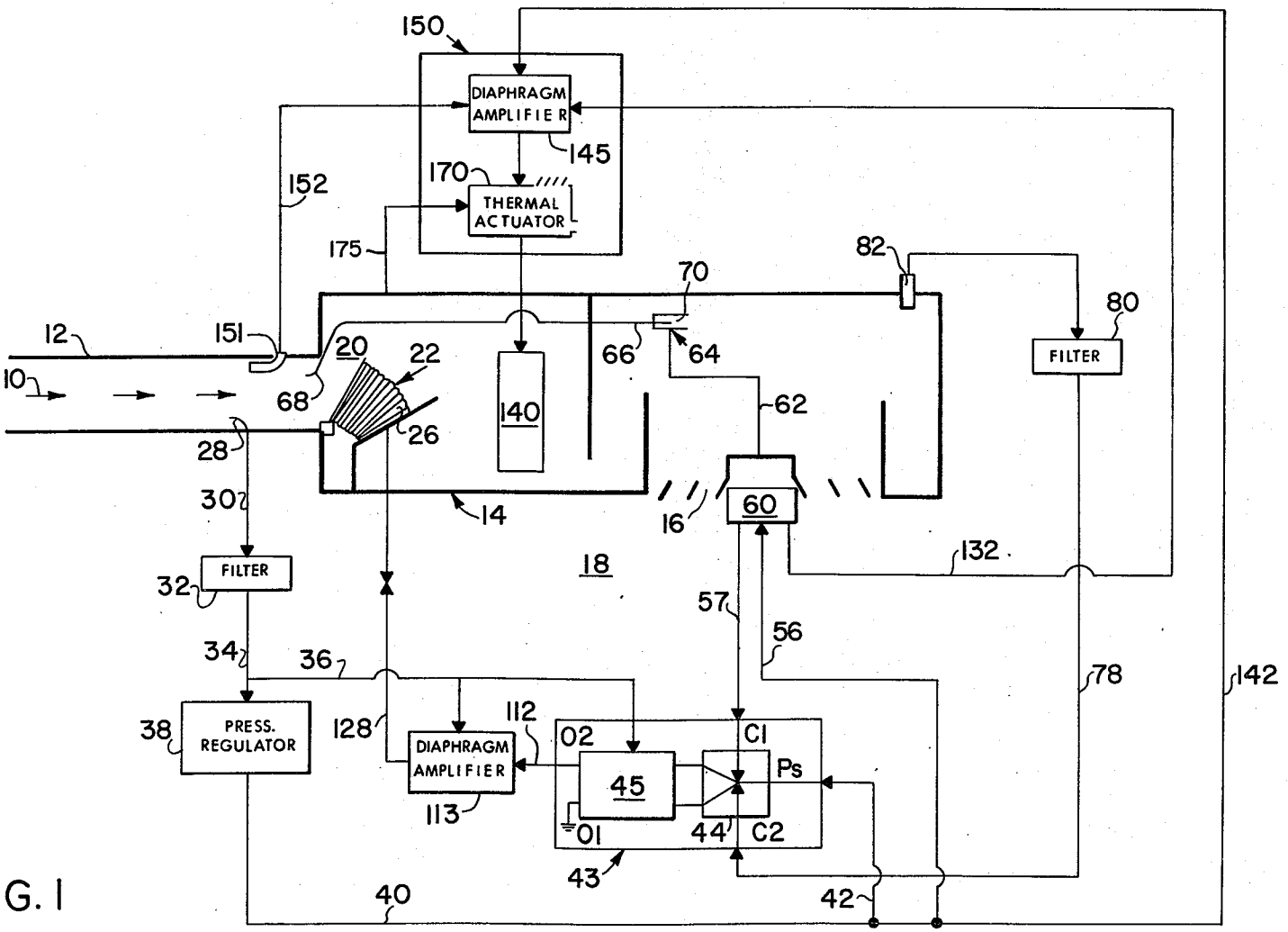
FIG. 1 is a schematic illustration of an air distribution system and a secondary conditioning apparatus in accordance with the present invention.

In accordance with the present invention, FIG. 1 shows an air distribution system having a secondary conditioning apparatus for heating previously cooled air when a zone being conditioned reaches a desired minimum temperature. With a few exceptions noted below, the illustrated system is similar to that described in my co-pending U.S. Pat. application Ser. No. 306,559, filed Nov. 15, 1972 and entitled Self-Controlled Air Distribution System. The present invention, however, is not limited to air distribution systems but may be employed as well in other fluid distribution systems.

Cooled or otherwise conditioned air represented by arrow 10 is introduced under pressure to a supply duct generally indicated at 12. The air flows through an opening 20 to a terminal box 14 which has a diffuser or outlet 16 leading to a zone 18 to be conditioned. The terminal box 14 and diffuser 16 may vary in construction. The zone 18 may comprise a room or other enclosure receiving the conditioned air or may simply be an area defined within a larger enclosure.

At the opening 20 to the terminal box 14, a valve 22 is provided for controlling air flow therethrough. As illustrated here and explained in our co-pending application, the valve 22 is preferably of the hinged damper type with a bellows type actuator 26. The actuator operates the valve in one and an opposite direction by applying as control signals positive and negative air pressures to the interior of the bellows. More specifically, positive pressurization of the bellows results in expansion thereof to move the valve 22 in the duct closing direction and negative pressurization or withdrawal of air therefrom results in bellows compression and valve movement in the duct opening direction. The actuator 26 is operated in response to sensed temperature and flow by a diaphragm amplifier 113 to maintain a controlled temperature without exceeding a designed maximum flow rate or output. The amplifier 113 is powered by conditioned air from the supply duct 12.

The control for the diaphragm amplifier 113 and the actuator 26 is of the fluidic type and comprises signal comparison and amplifying means taking the form of a differential fluidic amplifier 43 also powered by conditioned air from the supply duct 12. The amplifier 43 has associated means supplying at least two fluidic control signals thereto. The signals may be temperature responsive signals, pressure responsive signals, reference signals, etc., but in the preferred form shown, a terminal box pressure responsive signal and a zone temperature responsive signal are provided.

Figure 2:
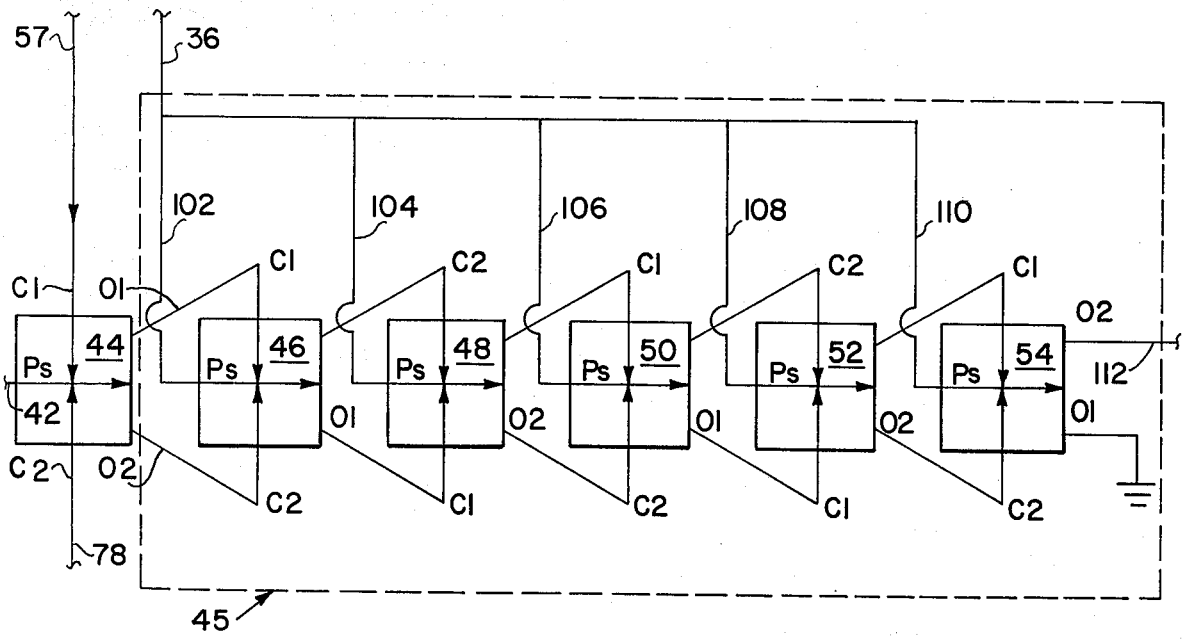
FIG. 2 is a schematic diagram of a fluidic comparator and amplifier used in the discharge control system of FIG. 1.

As mentioned, conditioned air from supply duct 12 is employed as a source of power for the actuator 26 and other air discharge controls. A total pressure pick-up or tap 28 communicates with a supply conduit 30 which extends in turn to filter 32 and thence to branch conduits 34 and 36. The branch conduit 34 communicates with pressure regulator 38 which maintains an output pressure at approximately ¾ of an inch of water in the air conditioning system. The output of regulator 38 is employed as a power supply input, $P_s$, via conduits 40, 42, for a first stage 44 of the multiple-stage fluidic amplifier 43. Five additional stages 46, 48, 50, 52 and 54 shown in detail in FIG. 2 are indicated generally at 45 in FIG. 1. As shown in FIG. 2, the power supply input $P_s$ for the additional stages is supplied via conduits 102, 104, 106, 108 and 110 which are in turn connected to branch conduit 36.

As shown in FIG. 1, a fluidic control signal $C_2$ representing the discharge pressure or air flow output from the terminal box 14 is provided as one of the inputs to the differential amplifier 43 from a duct pressure pick-up 82 via a conduit 78 and a filter 80. The pick-up 82 is shown in the terminal box 14 to give a terminal box pressure signal, but may be otherwise located. A second fluidic control signal $C_1$ representing duct or zone temperature at the diffuser 16 is provided as another of the inputs to the amplifier 43 from a thermostat 60 via conduit 57. The two input control signals $C_1$ and $C_2$ are effectively compared with one another and their difference, represented by the pressure difference of the two outputs $O_1$ and $O_2$ at each stage of the amplifier, is amplified through each stage. For a more complete description of the operation of the fluidic amplifier, reference can be had to my co-pending application Ser. No. 306,559. For present purposes, it is sufficient to understand that final stage outputs $O_1$ and $O_2$ will be proportional respectively to initial stage control input signals $C_1$ and $C_2$. The $O_1$ output is dumped to atmosphere as indicated. The output signal $O_2$ is connected via conduit 112 to the diaphragm amplifier 113.

Figure 3:
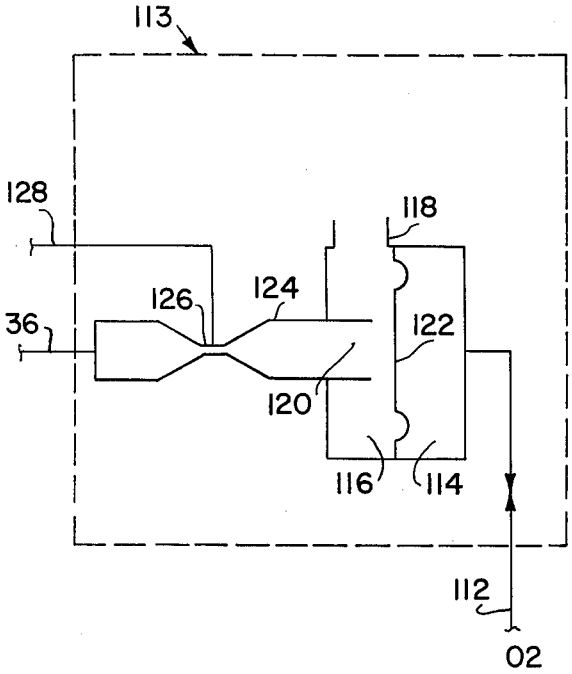
FIG. 3 is a schematic illustration of a fluidic diaphragm amplifier used in the control systems of FIG. 1.

As shown in FIG. 3 the final stage control output $O_2$ is operative and is applied by conduit 112 to a control chamber 114 of the diaphragm amplifier 113. The opposing chamber 116 is vented at 118 and envelops the discharging end of a venturi 124 connected to the supply duct 12 by the conduit 36. An orifice 120 is formed between the discharging end of the venturi and the diaphragm 122 and is controlled by the position of the diaphragm and correspondingly the $O_2$ output of the differential amplifier 48. Venturi 124 has a throat section 126 connected by a conduit 128 with the bellows actuator 26 for producing positive and negative pressures in the bellows to move the valve 22. In an air distribution system providing cooled air in the supply duct 12, high temperature signals from the thermostat 60 open the valve and low temperatures close the valve to a minimum flow condition or no flow condition. Low pressure signals from the tap 82 indicative of low output tend to open the valve 22 unless a low temperature signal overrides the pressure signal. A high pressure signal closes the valve and limits the air output to a maximum output designed for the zone 18 being conditioned.

Figure 4:
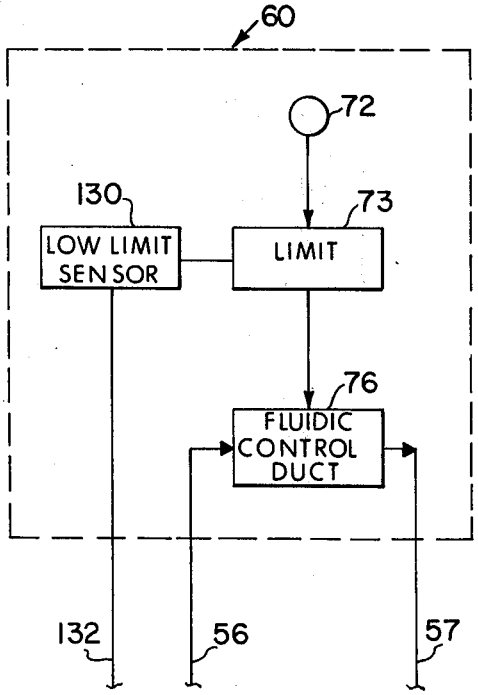
FIG. 4 is a block diagram of the fluidic thermostat in FIG. 1.
Figure 5:
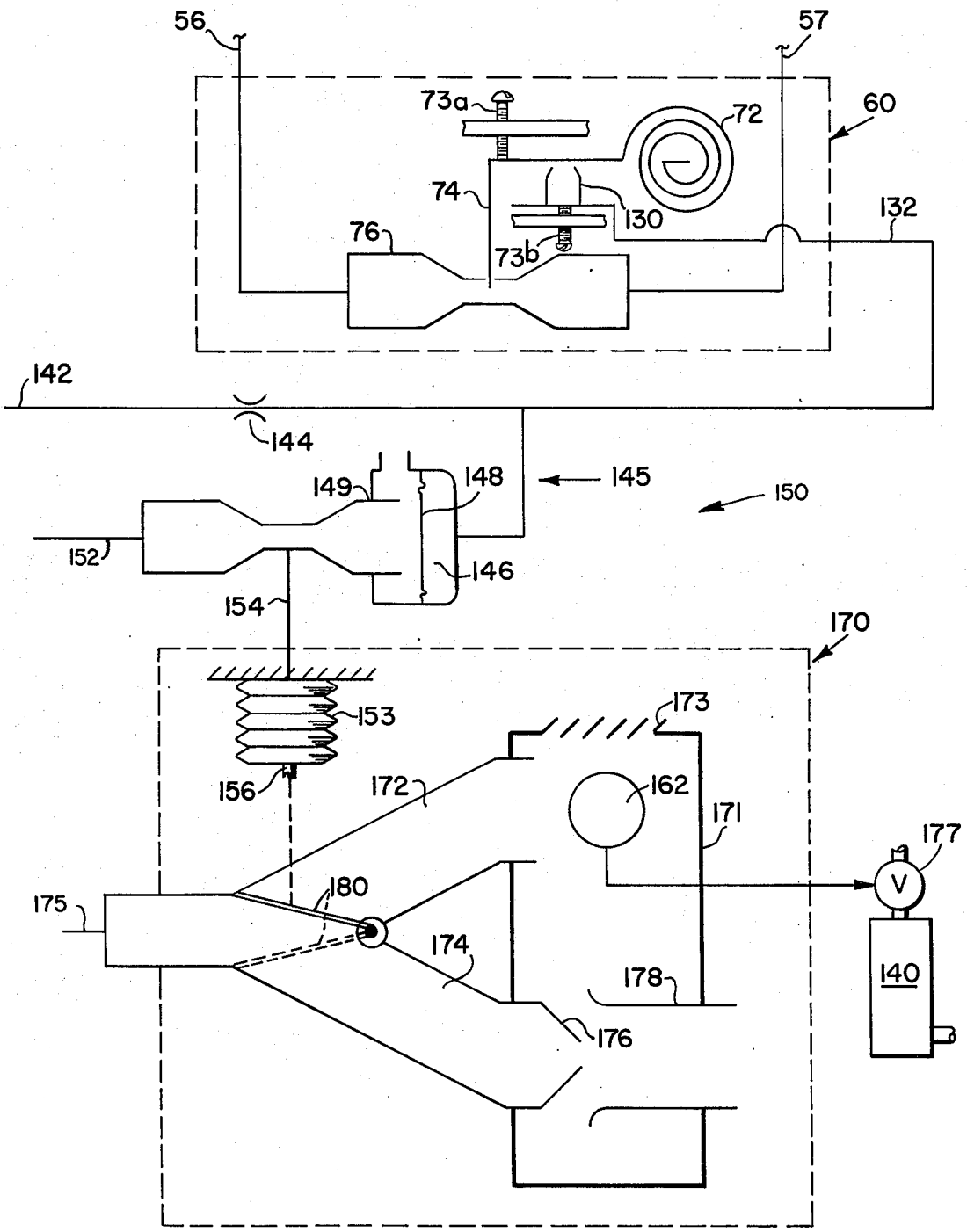
FIG. 5 is a schematic illustration of the fluidic thermostat of FIG. 4 and the associated thermal control of the secondary conditioning apparatus.

The block diagram representation of the thermostat 60 in FIG. 4 shows a temperature sensor 72 with an output constrained by a limiter 73 to control a fluidic control duct 76. Referring to FIG. 5, a preferred embodiment of thermostat 60 comprises a fluidic temperature transducer formed by a bi-metallic coil as the temperature sensor 72 with an end portion or mechanical output member 74 operable to interrupt a jet within the control duct 76. The supply end of the duct 76 is connected via conduits 56 and 40 to the source of regulated pressure 38 in FIG. 1. The output of the duct is the fluidic temperature signal from the thermostat 60 and connects to the differential amplifier 43 via conduit 57. The limiter 73 in FIG. 4 is comprised of two adjustable screws **73*a*, 73*b* in FIG. 5 which effectively constrain the motion of mechanical member 74. Screw 73a adjusts the magnitude of the maximum opening in duct 76 and, correspondingly, the maximum temperature signal from the thermostat. Similarly, screw 73*b*** adjusts the minimum temperature signal.

Figure 6:
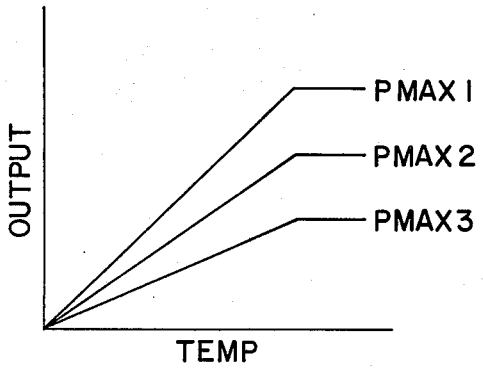
FIG. 6 is a graphic representation of the performance characteristics of a fluidic thermostat or conditioning system according to my co-pending application Ser. No. 306,559.
Figure 7:
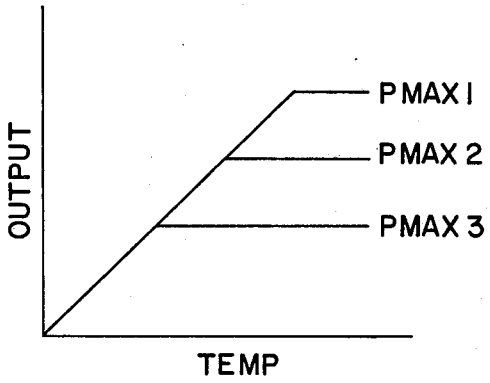
FIG. 7 is a graphic representation of the performance characteristics of a fluidic thermostat or conditioning system according to the present invention.

Limiting screw **73*a* eliminates the need for a variable pressure set-point restriction in duct 56 as described in our aforementioned co-pending application Ser. No. 306,559. The screw 73*a* is used to determine the maximum signal available for comparison with the duct pressure signal $C_2$ and ultimately, as will be seen, determines the maximum output of the air conditioning terminal box 14. The screw would normally be adjusted only once according to the design parameters of the zone being conditioned. It will be apparent that while the sensitivity of the thermostat or system (defined as the change in output divided by the change in temperature of the system) using the variable restriction in my co-pending application varies with the maximum output setting, the sensitivity of the present system does not. The sensitivities of the earlier system and the present system are illustrated in FIGS. 6 and 7** respectively. The characteristic curves for the thermostat or system output are plotted as a function of temperature for various maximum output settings.

Limiting screw **73*b* is adjustable to set the minimum output or temperature signal to some value greater than zero. The screw 73*b* constrains the mechanical temperature transducer 72 in the valve closing direction to prevent mechanical member 74 from completely blocking the air flow in duct 76. As will be seen, the lower limit ultimately insures some minimum flow of conditioned air through opening 20 into the terminal box 14 which is necessary for effective operation of the air heater 140 shown in FIG. 1 in the terminal box 14.** Such minimal flow may also be desirable in certain other air conditioning applications for other purposes.

Associated with limiting screw 73b is a lower limit detector 130 and signal transmitting tube 132 for sensing whether the bimetallic temperature sensor 72 is operating against its lower limit. Preferably as shown in FIG. 5, the limiting screw 73b acts against the limit detector 130, which in fact provides the mechanical constraint limiting the movement of temperature sensor 72 and member 74. The detector 130 is a small nozzle with an orifice under the bimetallic coil of temperature sensor 72. It is evident that as the temperature sensor 72 approaches the lower limit set by the limiting screw **73*b*, the orifice is closed. The control tube 132 is supplied with regulated air from conduit 142 through a restrictor 144. When the orifice is closed by the sensor 72, pressure in tube 132 rises and serves as a fluidic lower limit signal for any appropriate control elements such as the diaphragm amplifier 145 of the thermal control 150 in FIGS. 1 and 5.** Although a limit detector is shown only for the lower limit, it will be understood that such a detector may also be included for the upper limit if such a control function is desired in a particular application.

The thermostat 60 may be employed at the diffuser 16 in FIG. 1 or may be located at a remote position elsewhere in the zone. In the former case, it is presently preferred practice to provide for the aspiration of zone air over the thermostat and such provision is illustrated in FIG. 1. A conduit 62 has an inlet end disposed adjacent to thermostat 60 and extends therefrom to an aspirator 64. The aspirator 64 has a supply conduit 66 extending from a total pressure inlet 68 disposed in the supply duct 12 for total pressure pickup. As will be apparent, relatively high pressure duct air emitted from a nozzle 70 in the aspirator will tend to create a negative pressure adjacent the discharge end of conduit 62 and induce a flow of zone air over the thermostat 60. A further function of the aspirator 64 resides in the removal of the slight flow of cold air dumped from the control tube 76 of the thermostat. The cold air might otherwise affect the accuracy of the thermostat.

In accordance with another aspect of the present invention it is desirable in some installations to modify the conditioned air before it is introduced into the zone. This modification may take the form of humidifying the air, warming it, or even cooling it further. In the disclosed distribution system, the air is warmed by the heater 140 preferably provided in the terminal box 14, but other forms of conditioning may be employed without changing the nature of the invention. The heater is turned on, for example, when a minimum flow of air is to be maintained, but the temperature is near or at its lower limit. The heater may be of several conventional types, typically hot water or electric, and the thermal control means provided is suitable for operating the heater in response to the thermostat 60.

FIG. 5 shows a fluidically operated thermal control 150 for the heater 140 which, for purposes of explanation, is a hot water type heater. The control tube 132 for the low temperature detector 130 is connected between the restrictor 144 and the detector 130 to the chamber 146 of diaphragm amplifier 145. It can be seen that when the thermostat is operating at its lower limit, the orifice in detector 130 is closed and the pressure in chamber 146 increases to cause the diaphragm 148 to move toward the exit of venturi 149. The venturi 149 is supplied with conditioned air from conduit 152 and discharges the air through the annular orifice between the venturi and the diaphragm 148. A pressure tap 154 at the venturi throat connects with activating bellows 153 in the thermal actuator 170. Pressurizing the diaphragm in the chamber 146 when the temperature sensor 72 is at its lower limit against detector 130 increases the pressure in venturi 149 and extends the bellows 153. As the sensor 72 moves away from its lower limit, the pressure in chamber 146 is vented through conduit 132 and diaphragm 148 moves back towards its neutral position. Pressure in the venturi is relieved and the bellows 153 retracts to its neutral position. It may be noted that the movement of diaphragm 148 can be used to operate an electrical microswitch which in turn can be used to operate a heater. In this preferred embodiment, however, there is no electrical power requirement and a completely fluidic thermal control powered by duct air pressure is used.

The bellows 153 has a mechanical output rod 156 which might be used to directly operate a low force member controlling a flow valve in a hot water heater if such is used in the heater 140. However, since such valves usually require forces greater than a high response bellows can provide, a unique ducted plenum and thermal operator is employed.

Figure 8:
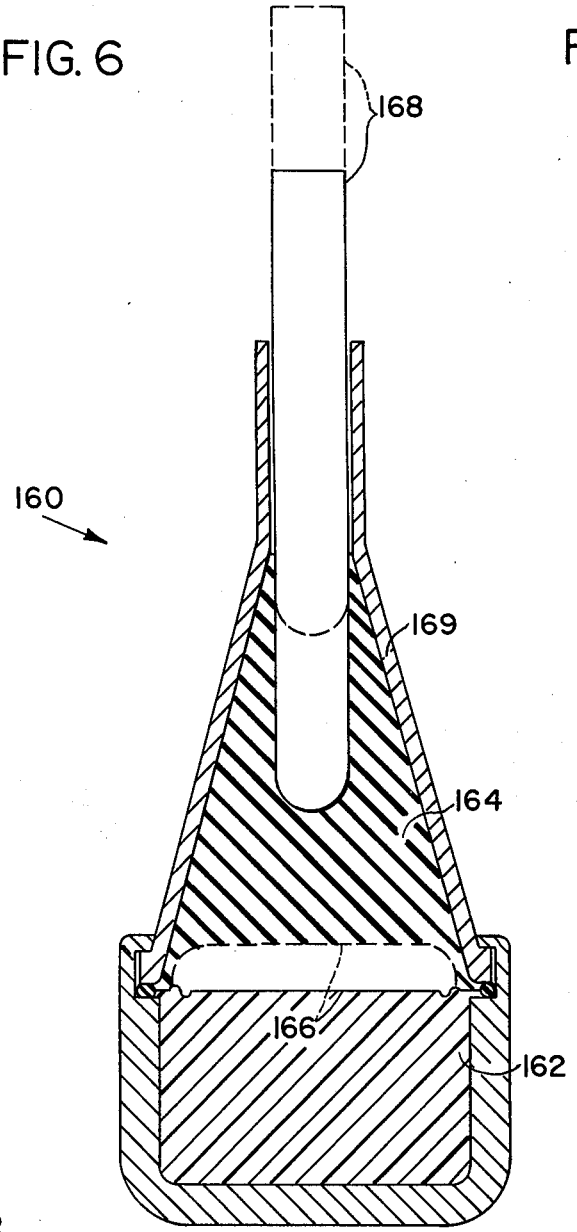
FIG. 8 is a vertical cross-sectional view of a thermal operator.

Referring to the cross-sectional view in FIG. 8 the thermal operator 160 is shown as comprising a lower bulb or chamber 162 which is filled with paraffin, a chamber 164 which is filled with an elastic material, and a sealed diaphragm 166 which separates the two chambers. A piston 168 is slidingly received in one cylindrical end of the housing 169 of chamber 164. As the temperature of the paraffin in chamber 162 rises, the paraffin changes state from solid to liquid and expands causing the paraffin to push the diaphragm toward the position indicated in phantom. The elastic material in chamber 164 is compressed and drives the piston 168 to the position indicated in phantom. If the temperature of the paraffin falls again, the process reverses and the displaced elements return to the illustrated positions.

The portion of the thermal actuator 170 which is operated by the bellows 153 and which utilizes the piston 168 of thermal operator 160 to open a flow valve is the ducted plenum 171 in FIG. 5. The plenum is preferably exposed to the warmer ambient air in the zone being conditioned. The bulb 162 of the thermal operator 160 is located within the plenum at the discharge end of a conduit 172. A nozzle 176 at the discharge end of a second conduit 174 directs a jet of air into an exhaust outlet 178 which communicates with the ambient environment. The inlet conduit 175 supplies the conduits 172 and 174 with cool, conditioned air from the supply duct 12 as shown in FIG. 1.

It is evident that if a flow of cool, conditioned air is directed through conduit 172 and over the bulb 162 of thermal operator 160, the plenum 171 becomes filled essentially with cool conditioned air. The resulting temperature of the thermal operator 160 will approximate the temperature of the conditioned air and retract the piston 168. It is likewise evident that if a flow of conditioned air through conduit 174 is directed through nozzle 176 causing a low pressure zone at outlet 178, a flow of warm air is induced through vent 173 over the thermal operator 160 and out of outlet 178. The plenum then becomes filled essentially with warm air and the temperature of the thermal operator 160 will approximate the temperature of the plenum air to extend the piston 168. Thus, by selectively directing a flow of conditioned air through either conduit 172 or conduit 174 a temperature variation as great as 20°–25°F. can be induced at the thermal operator which is quite sufficient for satisfactory operation.

The preferred mechanism used to selectively direct the flow through one or the other of conduits 172 or 174 is a fluid gate valve. Conduits 172 and 174 are "Y" connected to the supply duct 175 (also shown in FIG. 1) from the terminal box 14, and a gate 180 pivotally mounted at the "Y" swings between the phantom position or the illustrated position to direct conditioned air through one and to close off the other of the conduits 172 and 174. The output rod 156 of the actuating bellows 153 is connected to the gate 180 so that the bellows can swing the gate in response to the temperature signal from thermostat 60.

When the thermostat 60 is cooled by the conditioned air in zone 18 to the minimum temperature established by the lower limit screw 73*b*, the detector 130 is closed off and the diaphragm amplifier 145 pressurizes the bellows 153 and moves the gate 180 to the phantom position illustrated in FIG. 5. Cooled, conditioned air then passes from the duct 175 into the conduit 172 over the bulb 162 of the thermal operator 160 into the plenum 171. As the thermal operator responds to the cooler air, its piston 168 retracts and the retracting motion is utilized to open a conventional hot water flow control valve 177 of the heater 140. Hot water then flows through the heater and slightly warms or tempers the conditioned air passing through the terminal box 14. The warmed air then is exhausted through the diffuser 16 into the zone 18 to be conditioned.

When the thermostat 60 subsequently detects higher temperatures in the zone 18, the bimetallic temperature sensor 72 moves off of the detector 130 and relieves pressure in the control tube 132. The diaphragm amplifier 145 relieves pressure within the actuating bellows 153 and causes the gate 180 to be moved from the phantom position to the position illustrated. Cold air is prevented from passing through the conduit 172 and instead passes through the conduit 174 and its nozzle 176. The aspirator formed by the nozzle 176 and outlet 178 produces a flow of warm or ambient air from an associated hot air heating duct or the zone 18 being conditioned through the plenum 171 from the inlet vent 173 to the outlet 178. Since the conditioned air supplied from duct 152 is normally 20°–25° F. cooler than the ambient air in the zone 18, the thermal operator 160 experiences a substantial temperature increase which extends the piston 168 shown in FIG. 8 to close the hot water flow valve 177 in the heater 140. As a result cool conditioned air passing through the terminal box 14 is not warmed by the heater and, therefore, colder air is emptied into the zone 18 again to lower the sensed temperature.

EXAMPLE

Assume that the design specification for a particular air outlet installation calls for maximum flow rate of 400 CFM into the zone to be conditioned and that this corresponds to a pressure of .25 inches of water at the terminal box as measured at pick-up 82. Since this maximum flow rate is desired when maximum cooling is required, the limit screw 73a defining an upper temperature limit is adjusted to provide a maximum gain of 0.33 through control duct 76 when the temperature sensor 72 is against the screw. When maximum cooling is called for, the temperature input at $C_1$ of fluidic amplifier 44 will be $.75 \times .33 = .25$ inches of water. With valve 22 wide open, the signal at pick-up 82 is .4 inches of water which will be the pressure input of $C_2$ of amplifier 44. Under such conditions, the $O_2$ output signal at the final stage of amplifier 43 and in the diaphragm chamber 114 will be high causing the diaphragm 122 to close orifice 120, in turn pressurizing bellows 26 and causing valve 22 to be moved in the closing direction. Equilibrium will be established when the duct pressure at pickup 82 equals .25 inches of water and the signals at $C_1$ and $C_2$ are equal.

Assume now a change in thermal load in zone 18 causing a cool condition for occupants. Thermostat 60 reacts with its temperature sensor 72 moving the member 74 from its high limit further into duct 76 to decrease the gain and thereby decrease the temperature signal in conduit 57 and at input $C_1$. With $C_1$ less than $C_2$, the final stage output $O_2$ of amplifier 43 causes diaphragm 122 to close orifice 120, and further pressurize bellows 26 until the pressure at pickup 82 and at $C_2$ corresponds to the reduced signal at $C_1$.

If the thermal load in zone 18 continues to decrease, eventually sensor 72 hits the lower limit defined by detector 130 and limit screw 73*b*. If the lower limit screw 73b is adjusted for a minimum signal of .1 inches of water at $C_1$, it is evident that the minimum flow of conditioned air into the zone will correspond to a pressure of .1 at pickup 82. As described earlier, operation of the thermostat 60 at its lower limit causes the heater 140 to be turned on. The air flowing over the heater is warmed before introduction into the zone and the flow of warmed air into the zone causes the zone temperature to rise.

As zone temperature rises, the transducer 72 moves off of its lower limit and the heater 140 turns off. If the temperature continues to rise, the member 74 will be moved further out of the duct 76 and increase the temperature signal at $C_1$. With $C_1$ greater than $C_2$, the final stage output $O_2$ of amplifier 43 will be lowered in an amount proportional to the temperature change to permit diaphragm 122 to move away from orifice 120 and cause the bellows 22 to be deflated. This causes valve 22 to move in the valve opening direction and increases the flow of conditioned air into the zone until equilibrium is reached.

While the present invention has been described in a preferred embodiment, it will be understood that numerous modifications and substitutions can be had without departing from the spirit of the invention. For example, the thermal actuator 170 illustrated in FIGS. 1 and 5 need not be a fluidically operated actuator although such a construction is desirable since it eliminates the need for auxiliary electrical or pneumatic power. Also, other fluidic controls may be used to control the flow of cooled, conditioned air through the plenum chamber 171. As an example, a fluidic valve operated by the diaphragm 148 of the fluid amplifier may be used in place of the actuating bellows 153 and mechanical gate 180 to direct the conditioned air through the ducts 172 and 174. The secondary conditioning controlled by the thermostat need not necessarily be for the purpose of warming the conditioned air and, as mentioned, it is contemplated that further cooling of the conditioned air at the local terminal boxes may be desired. For cooling, a heat exchanger in the form of an evaporator coil replaces the heater 140. Therefore, a heat transfer device providing either heating or cooling is installed in the terminal box in accordance with the end-result desired from the secondary conditioning apparatus. In this respect, the term "heat transfer device" as used in this specification is used broadly and includes electrical heaters, radiators producing heat by various means and evaporators such as used in air conditioning equipment. Accordingly, the present invention has been described in a preferred embodiment by way of illustration rather than limitation.

We claim:

1. In an air distribution system for supplying conditioned air to at least one zone to be conditioned, the combination of:

a supply duct connected with a source of conditioned air under pressure and having an air outlet communicating with the zone;

a valve in said duct movable in duct opening and closing directions;

a control for said valve including a fluidic signal comparison and amplifying means, a fluid power supply conduit for the fluidic amplifying means connected with said duct, a thermostat providing a temperature responsive fluidic signal to said comparison and amplifying means, means providing a duct pressure signal to said comparison means, a valve actuator connected to the valve in the duct and operated by the comparison and amplifying means, said actuator being connected with said valve for movement of the valve in said duct opening and closing directions;

secondary conditioning means for further conditioning the air before it is introduced into the zone from the duct; and secondary conditioning fluidic control means operable in conjunction with and under control of said thermostat for regulating said secondary conditioning means.

2. The combination as set forth in claim 1 wherein said thermostat comprises:

a fluidic temperature transducer producing a fluidic temperature signal indicative zone air temperature; and means for sensing a desired minimum temperature and providing a corresponding fluid signal to said secondary conditioning control means.

3. The combination in an air distribution system as set forth in claim 2 wherein:

said fluidic temperature transducer comprises a fluid control duct, a temperature responsive mechanical element, and means for varying the flow through said control duct in response to said mechanical element; and the sensing means includes adjustable limiting means having a manually adjustable mechanical stop for restraining motion of said mechanical element and correspondingly the variation of flow through the control duct.

4. The combination in an air distribution system as set forth in claim 3 wherein said sensing means comprises a fluid tube with an orifice at a discharge end thereof mounted on the mechanical stop, the orifice being covered by the mechanical element at the desired minimum temperature to produce the desired minimum temperature signal.

5. The combination as set forth in claim 4 wherein said secondary conditioning control includes a diaphragm amplifier connected to the supply duct for receiving a continuous supply of conditioned air and connected with the tube and orifice of the sensing means and for receiving the minimum temperature signal.

6. In a fluid distribution system having a supply duct and flow control means responsive to a fluidic temperature signal for regulating the flow of conditioned fluid to at least one zone to be conditioned, local secondary conditioning apparatus for further conditioning the fluid before the fluid is introduced into the zone comprising: heat transferring means positioned in the supply duct in the stream of conditioned fluid and having a controlled member for adjusting the rate of heat transfer with the conditioned fluid in the duct; and fluidic control means for both said flow control means and said heat transferring means including an actuator responsive to the fluidic temperature signal and connected to operate the controlled member of the heat transferring means and a fluidic thermostat providing a fluid temperature responsive signal to the actuator and the flow control means for regulating the flow of conditioned fluid and for regulating the heat transferring means.

7. The secondary conditioning apparatus as set forth in claim 6 wherein said heat transferring means comprises a heater positioned within said duct for warming the conditioned fluid before it is introduced into said zone.

8. The secondary conditioning apparatus as set forth in claim 6 wherein:

the fluidic control means includes a diaphragm amplifier having an output connected with the actuator means and a fluidic input connected with the thermostat and receiving the fluidic temperature responsive signal from the thermostat.

9. The conditioning apparatus as set forth in claim 8 wherein:

said heat transferring means receives a secondary fluid and the controlled member is a flow control valve for regulating the flow of secondary fluid through the heat transferring means; and the output of said diaphragm amplifier in the fluidic control means is operatively connected though the actuator with the flow control valve for regulating the flow of secondary conditioning fluid.

10. The secondary conditiong apparatus of claim 6 wherein:

the actuator is a fluid energized thermal actuator having a fluid inlet connected to receive conditioned fluid from the supply duct, two fluid discharges, means responsive to the fluidic temperature signal for diverting the fluid entering the inlet to one or the other of the fluid discharges and a thermal operator associated with one of the fluid discharges and having an output connecting with the controlled member of the heat transferring means.

11. The secondary conditiong apparatus of claim 10 wherein:

the means for diverting comprises a gate interposed between the inlet and two discharges and a fluidic amplifier connected for fluid power to the supply duct and receiving the fluidic temperature signal from the thermostat.

12. The secondary conditioning system as in claim 11 for an air distribution system distributing conditioned air from the supply duct to the zone to be conditioned wherein:

the thermal actuator further includes a plenum chamber having an opening communicating with the zone to be conditioned for ingesting air from the zone, and an aspirator which is driven by fluid passing through one of the two fluid discharges and which pulls air out of the plenum;

the thermal operator is mounted in the plenum and has a thermally sensitive portion located adjacent the opening; and the other of the two fluid discharges empties into the plenum onto the thermally sensitive portion of the transducer.

13. The secondary conditioning apparatus of claim 10 wherein:

the means for diverting includes a gate valve interposed between the inlet and the discharges and an expandible bellows responsive to the fluidic temperature signal and having a movable output member connected to the gate valve.

14. The secondary conditioning apparatus for an air distribution system as defined in claim 6 wherein:

the heat transferring means comprises a hot water heater having a flow control valve as the controlled member for regulating the flow of water through the heater; and the actuator is connected to operate the flow control valve.

15. The secondary conditioning apparatus as defined in claim 6 wherein:

the thermostat includes limit means providing the fluidic temperature signal at a preselected limiting temperature; and the actuator and heat transferring means are responsive to the fluidic temperature signal at the preselected limiting temperature.

* * * * *